US006517024B1

(12) United States Patent
Gambini

(10) Patent No.: US 6,517,024 B1
(45) Date of Patent: Feb. 11, 2003

(54) DEVICE FOR INTRODUCING A WINDING CORE INTO A RE-REELING MACHINE

(76) Inventor: Giovanni Gambini, Via A. Omodeo 7, I - 56100 Pisa (IT)

( * ) Notice: Subject to any disclaimer, the term of this patent is extended or adjusted under 35 U.S.C. 154(b) by 17 days.

(21) Appl. No.: 09/702,079

(22) Filed: Oct. 30, 2000

(30) Foreign Application Priority Data

Nov. 3, 1999 (IT) ..... MI99A2293

(51) Int. Cl.[7] ..... B65H 19/30
(52) U.S. Cl. ..... 242/533
(58) Field of Search ..... 242/533, 533.1, 242/542, 542.1, 542.2

(56) References Cited

U.S. PATENT DOCUMENTS

| | | | | | |
|---|---|---|---|---|---|
| 3,239,155 | A | * | 3/1966 | Kinoshita | 242/533.1 |
| 3,720,381 | A | * | 3/1973 | Rehme | 250/369 |
| 3,908,923 | A | * | 9/1975 | Salgo | 242/421.2 |
| 4,299,358 | A | * | 11/1981 | Dropczynski | 242/533.7 |
| 4,327,877 | A | * | 5/1982 | Perini | 242/521 |
| 4,370,193 | A | * | 1/1983 | Knauthe | 242/527.2 |
| 4,422,588 | A | * | 12/1983 | Nowisch | 242/524.1 |
| 4,572,451 | A | * | 2/1986 | Ikeda | 242/527.3 |
| 4,711,405 | A | * | 12/1987 | Niskanen | 242/532.3 |
| 4,909,452 | A | * | 3/1990 | Hertel | 242/521 |
| 4,974,786 | A | * | 12/1990 | Dropczynski | 242/542.3 |
| 5,031,850 | A | * | 7/1991 | Biagiotti | 242/521 |
| 5,577,684 | A | * | 11/1996 | Dropczynski | 242/533.2 |
| 5,769,352 | A | * | 6/1998 | Biagiotti | 242/521 |
| 5,820,064 | A | * | 10/1998 | Butterworth | 242/533.2 |
| 5,937,629 | A | * | 8/1999 | Spindler | 57/281 |

FOREIGN PATENT DOCUMENTS

EP 0387214 9/1990

* cited by examiner

*Primary Examiner*—William A. Rivera
(74) *Attorney, Agent, or Firm*—Hedman & Costigan, P.C.

(57) ABSTRACT

A device (11) for introducing a winding core (32) into a re-reeling machine, where the re-reeling machine comprises a winding assembly (14) for winding a ribbon of paper around the cores (32) and a feeder (34*a*, 34*b*) for feeding the cores (32) to the device (11). The device (11) for introducing a core (32) further comprises two guides (22) connected to a frame (20) of the machine, on each of which at least one carriage (24) can slide. Fixed to these two carriages (24) is a bar (26) which carries supports (28) for supporting the cores (32) in such a way that the feeders (34*a*, 34*b*) can supply the same cores (32) to the supports (28), which introduce them into the winding assembly (14).

11 Claims, 2 Drawing Sheets

DEVICE FOR INTRODUCING A WINDING CORE INTO A RE-REELING MACHINE

The present invention refers to a device for introducing a winding core into a re-reeling machine.

As is known, in the paper industry the production process envisages a stage in which the paper, at the end of the production process and prior to the stage of packaging in a commercial format, is wound in rolls of large dimensions. From these rolls the paper is unwound and treated to be converted into a format suitable for marketing.

In what follows, reference will be made to paper products prepared for sending to the market in the form of rolls, such as toilet paper, paper towels, and the like.

In these cases, the paper must be unwound from the original roll and, after undergoing the treatments required, must be re-wound on a secondary roll. Finally, the secondary roll is cut according to planes orthogonal to its own axis into rolls of smaller size.

Usually these treatments involve making lines of preferential tearing that are transverse to the ribbon of paper. The tearing lines are made using machines, which are in themselves known, provided with rotary blades over which passes the ribbon of paper being processed.

The machines that perform this operation on the one side support the primary roll, from which the ribbon of paper is unwound in continuous manner, and on the other have a winding assembly for winding the ribbon of paper, on which the preferential tearing lines are made, into secondary rolls.

Since from a primary roll a number of secondary rolls of pre-determined dimensions are usually obtained, the assembly for winding into rolls is integrated with a device for introduction of the winding cores, on which the ribbon of paper that is to form the secondary rolls is wound.

The said introduction device introduces a tubular cardboard core only after a given amount of ribbon of paper has been wound on a previous core and at the same time causes tearing of the ribbon in such a way that from the re-reeling machine it is possible to take out a roll that is already of commercial thickness. This roll may subsequently be packaged and marketed.

The stage of introduction of the cardboard cores into the winding assembly must be performed with extreme precision. Consequently, an important technical problem is obtaining an optimal precision in the introduction of the cores into the winding assembly, with a level of performance superior to what has been achievable up to now.

A purpose of the present invention is therefore to solve the above technical problem by providing a device for introducing a winding core into a re-reeling machine that may enable introduction of the cores into the winding assemblies in a very precise way so as to guarantee the production of high-quality articles.

Another purpose of the present invention it to provide a device that will enable production of rolls with a very precise number of sheets or lengths of paper.

A further purpose of the invention is to provide a device that is substantially inexpensive and at the same time extremely versatile.

Up to the present day, in fact, the devices used have been of the mechanical cam type or linkage type. In these devices, movement of the winding core depends on the profile of the cam or the geometry of the linkage, whereas in the device according to the present invention the movement of the winding core may be varied electronically.

Not the least important purpose of the invention is to provide a device for introducing a winding core into a re-reeling machine that is basically simple, safe and reliable.

These and other purposes according to the present invention are achieved by providing a device for introducing a winding core into a re-reeling machine, as specified in the Claims.

Further characteristics of the present invention are moreover defined in the subsequent claims.

Advantageously, the device according to the invention enables the formation of rolls of paper with a very regular start of winding.

Further characteristics and advantages of a device for introducing a winding core into a re-reeling machine according to the present invention will emerge more clearly evident from the ensuing description, which is provided purely to give an explanatory and non-limiting example, with reference the annexed schematic drawings, in which.

Figure 2:
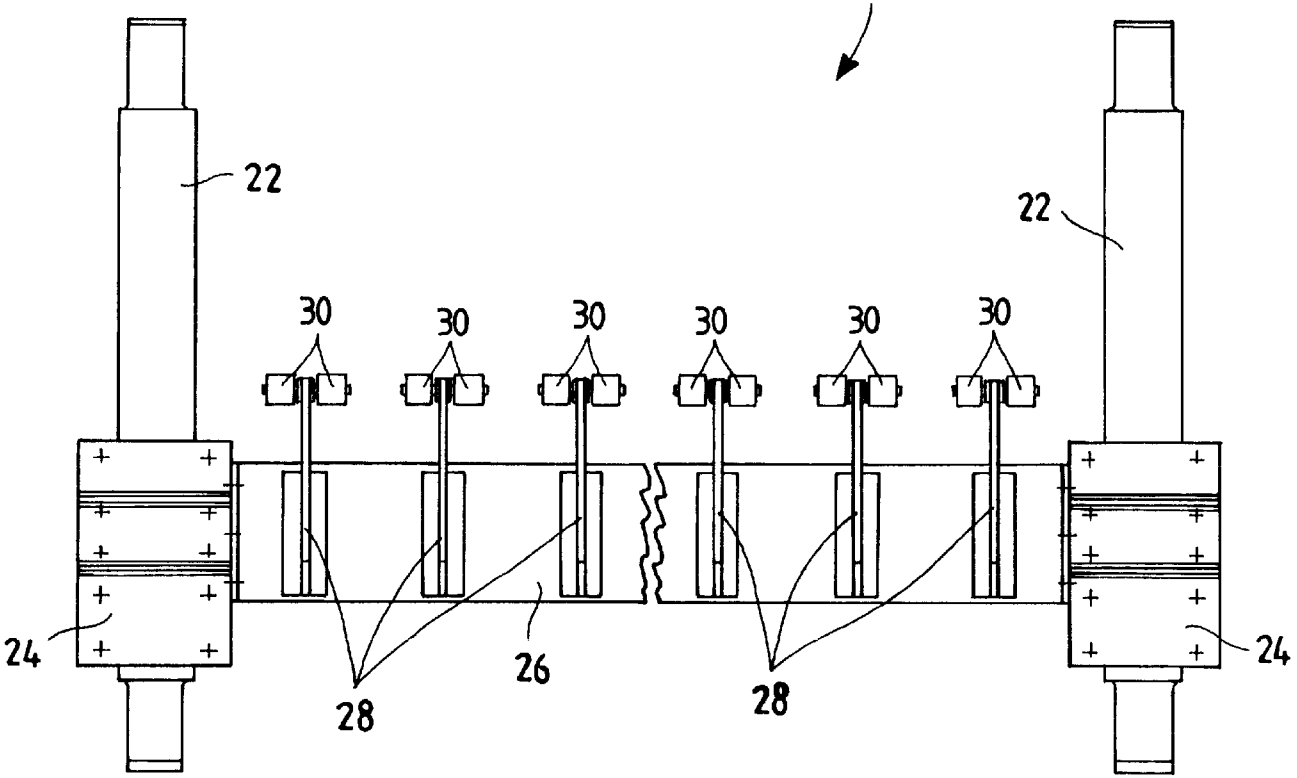
FIG. 2 is a top plan view of the device of FIG. 1.
Figure 1:
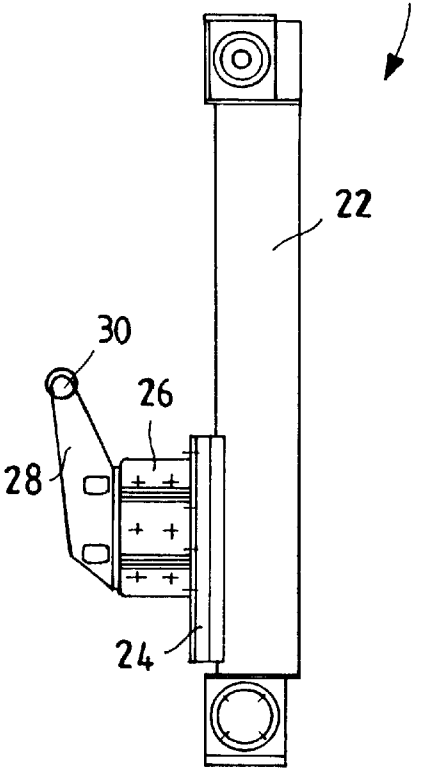
FIG. 1 is a side elevation view of a device for introducing a winding core into a re-reeling machine according to the present invention.

With reference to the above-mentioned figures, a device for introducing a winding core into a re-reeling machine is illustrated and is designated, as a whole, by the reference number 11.

The device 11 is mounted on a re-reeling machine, which is not shown in its entirety in that it is of itself known.

The re-reeling machine comprises a supporting assembly (not shown) from which a ribbon of paper that is processed in a perforating assembly (not illustrated) is unwound. The perforating assembly makes pre-determined tearing lines on the ribbon at equal distances apart.

The ribbon thus processed is subsequently rewound into rolls 12 by a winding assembly 14 of the re-reeling machine. The said winding assembly 14 comprises three rollers 16 that identify a space in which the roll 12 is temporarily housed during processing.

More in particular, two winding rollers 16 and 16*a,* and a third, mobile, roller 16*b,* also referred to as "pressure roller" are present.

The machine comprises a frame provided with cross members 20 on which two guides 22 are fixed. On each of the guides 22 a carriage 24 can slide on which are fixed the two ends of a bar 26. The latter is made of extremely rigid and light material, such as a composite material.

Fixed on the bar 26 are supports 28 set at equal distances apart. The supports 28 are made using elongated plates at one end of each of which is set a pair of rollers 30 supported by a pin.

The re-reeling machine comprises, as feeder for feeding winding cores 32 to the device 11, a pair of chutes that guide a cardboard core 32 from a gluer-feeder assembly (not shown), where the said cores 32 are deposited, as far as the winding assembly 14.

In particular, each chute comprises a first rectilinear portion 34*a,* which extends from the container and connects at right angles to a second portion 34*b,* which is also rectilinear and ends so that it is tangential to one of the rollers 16 of the winding assembly 14.

The bar 26 is connected to an actuator 26*a,* which drives it so that it moves along the guides 22. The actuator is in turn connected to an electronic control unit 26*c* which controls it.

According to a variant of the present invention, the device is equipped with two motors 26*b,* each of which is associated to an actuator 26*a,* the said actuators being controlled synchronously by means of an electronic control.

Operation of the device 11 for introducing a core 32 into a re-reeling machine according to the invention is substantially as described in what follows.

Figure 3:
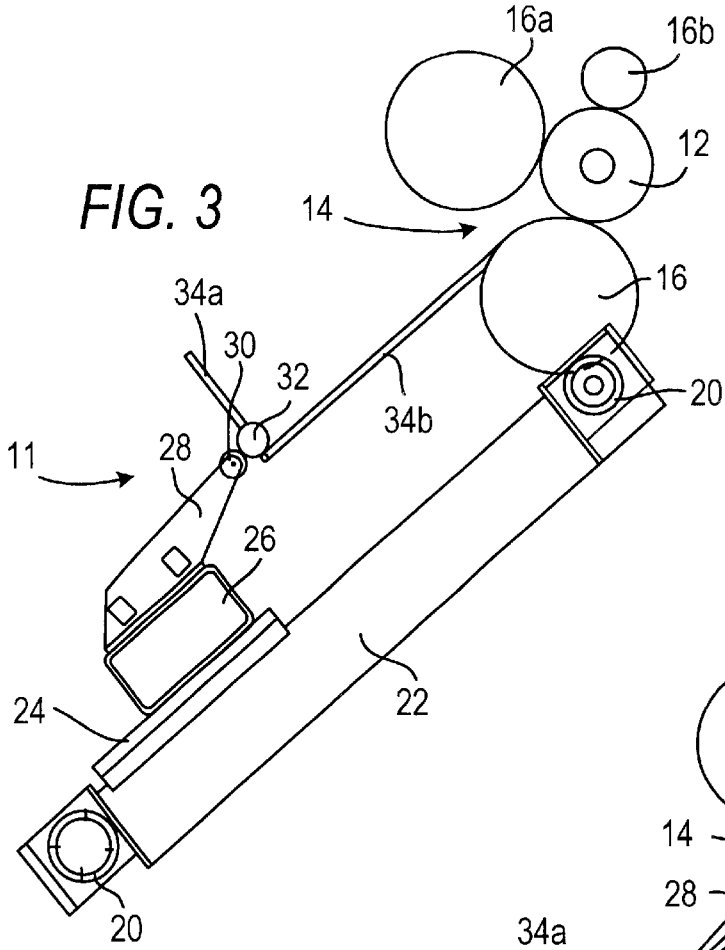
FIG. 3 is a schematic view of a portion of a re-reeling machine, with the device according to the invention in one first position.

The cardboard core 32 slides along the portion 34*a* of the chutes and stops at the portion 34*b* (FIG. 3).

Figure 4:
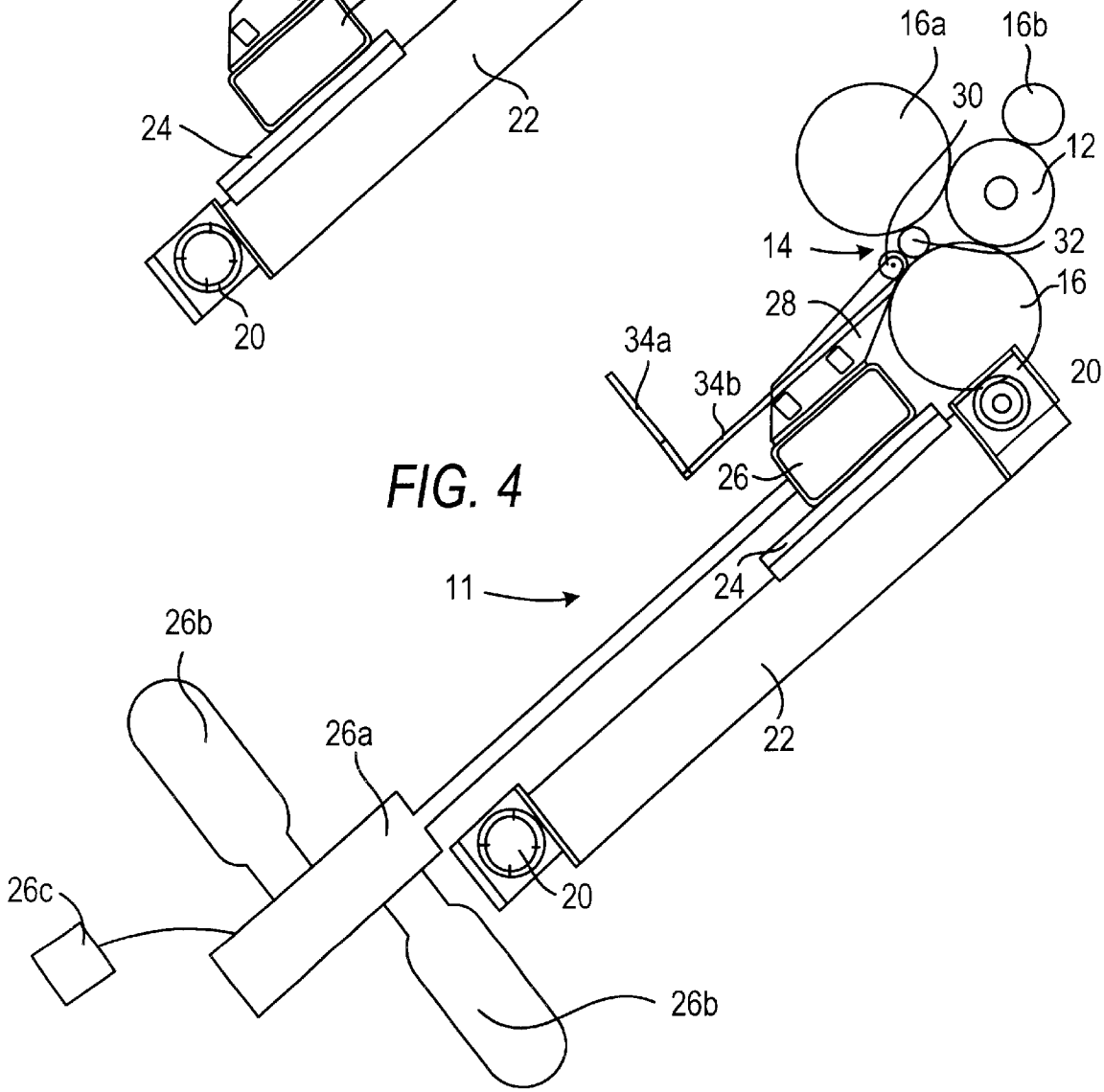
FIG. 4 is a schematic view of a portion of a re-reeling machine, with the device according to the invention in one second position.

Next, the bar 26, driven by the actuator (or actuators) slides by means of the carriages 24 on the guides 22, and when the wheels 30 arrive in contact with the cores 32, they push the latter, translating them along the portion 34*b* of the chutes, so as to supply them to the winding assembly 14 (FIG. 4).

The impact between the winding core 32 and the ribbon of paper, and in particular, the instant in which this impact occurs, contributes to causing tearing of the paper and the start of a new roll 12.

The electronic control unit determines the speed at which the bar 26 and the carriages 24 fixed to the latter move along the guides 22, and hence the speed at which the winding cores 32 are introduced between the rollers 16.

The speed of introduction and the instant of impact between the ribbon of paper and the cores 32 is very important for the purposes of making a good-quality finished roll 12.

The speed at which the core 32 is introduced between the rollers 16 is linked to the speed of the ribbon of paper.

The presence of the wheels 30 proves very useful in that the said wheels, in addition to supporting the core 32, enable its rotation at the instant of impact between the rollers 16.

The system in question enables levels of performance in terms of precision and dynamics that up to now have not been achievable, considerably improving the versatility of the re-reeling machine and the quality of the finished product.

In practice, it has been found that the device for introducing a winding core into a re-reeling machine according to the invention is particularly advantageous because it enables introduction of the cardboard cores of the rolls of paper in a very precise way, so obtaining finished products of very precise dimensions and high quality.

The device for introducing a winding core into a re-reeling machine as devised may undergo numerous modifications and variations, all falling within the scope of the present invention. In addition, all the items may be replaced with others that are technically equivalent.

In practice, the materials used, as well the dimensions, may be any whatsoever according to the technical requirements.

What is claimed is:

1. A device (11) for introducing a winding core (32) into a re-reeling machine, where said re-reeling machine comprises at least one winding assembly (14) for winding a ribbon of paper around said winding core (32) and a feeder (34*a,*34*b*) for feeding said winding core (32) to said device (11), characterized in that the device comprises at least one guide (22) connected to a frame (20) of said machine, at least one carriage (24) which moves along on said at least one guide (22), there being fixed to said at least one carriage (24) at least one movable bar, said at least one movable bar being also adapted to carry supports (28) which are adapted to move said winding core along at least part of said feeder (34*a,*3*b*) to introduce said winding core into said winding assembly.

2. A device (11) according to claim 1, characterized in that said supports (28) are set at equal distances apart.

3. A device (11) according to claim 2, characterized in that said supports (28) are made using elongated plates.

4. A device (11) according to claim 3, characterized in that at the ends of said supports (28) at least one wheel (30) is present.

5. A device (11) according to claim 1, characterized in that said feeder (34*a,* 34*b*) comprises at least one pair of chutes that guide said winding core (32) up to said at least one winding assembly (14).

6. A device (11) according to claim 5, characterized in that each chute comprises at least a first portion (34*a*) capable of receiving said winding core (32), and is connected at right angles to a second portion (34*b*).

7. A device (11) according to claim 6, characterized in that said second portion (34*b*) ends at a point tangential to at least one roller (16) of said at least one winding assembly (14).

8. A device (11) according to claim 1, characterized in that said at least one bar (26) is connected to at least one actuator (26*a*), which drives said device (11) so that said device (11) moves along said guides (22), said actuator (26*a*) being controlled by at least one electronic control unit (26*c*).

9. A device (11) according to claim 8, characterized in that the device (11) comprises two motors (26*b*), one for each actuator, controlled synchronously by means of an electronic control (26*c*).

10. A device (11) according to claim 1, characterized in that said at least one bar (26) is made of a composite material.

11. A device (11) according to claim 1, characterized in that said at least one winding assembly (14) comprises at least three rollers (16, 16*a,* 16*b*) which identify a space in which a roll (12) is temporarily housed during processing, where one of said rollers (16*b*) is a mobile roller.

* * * * *